US007350739B2

(12) United States Patent
Maddaleni et al.

(10) Patent No.: US 7,350,739 B2
(45) Date of Patent: Apr. 1, 2008

(54) METHOD FOR PRODUCING LOGS OF WEB MATERIAL AND REWINDING MACHINE IMPLEMENTING SAID METHOD

(75) Inventors: Romano Maddaleni, Pisa (IT); Roberto Morelli, Lucca (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 398 days.

(21) Appl. No.: 10/531,455

(22) PCT Filed: Oct. 14, 2003

(86) PCT No.: PCT/IT03/00624

§ 371 (c)(1),
(2), (4) Date: Apr. 14, 2005

(87) PCT Pub. No.: WO2004/035441

PCT Pub. Date: Apr. 29, 2004

(65) Prior Publication Data

US 2005/0258298 A1 Nov. 24, 2005

(30) Foreign Application Priority Data

Oct. 16, 2002 (IT) ..... FI2002A0194

(51) Int. Cl.
*B65H 18/14* (2006.01)

(52) U.S. Cl. ..... 242/542; 242/532.3; 242/542.1

(58) Field of Classification Search ..... 242/521, 242/533.1, 532.3, 542, 542.1, 542.4
See application file for complete search history.

(56) References Cited

U.S. PATENT DOCUMENTS 3,030,042 A * 4/1962 De Gelleke ..... 242/527.3
3,073,008 A * 1/1963 McGraw, Jr. ..... 29/25.42
3,393,105 A 7/1968 Tellier, Jr.
3,553,055 A 1/1971 Janik
4,487,377 A 12/1984 Perini
5,242,525 A 9/1993 Biagiotti
6,948,677 B2 * 9/2005 Biagiotti et al. ..... 242/521
7,172,151 B2 * 2/2007 Biagiotti et al. ..... 242/521
7,222,813 B2 * 5/2007 Tung-I ..... 242/521
2006/0076450 A1 * 4/2006 Gelli et al. ..... 242/526

FOREIGN PATENT DOCUMENTS

| | | |
|---|---|---|
| EP | 0 481 929 A1 | 4/1992 |
| EP | 0 699 168 B1 | 1/1997 |
| EP | 1 006 066 A2 | 6/2000 |
| EP | 1 006 066 A3 | 5/2001 |
| GB | 2 150 536 A | 7/1985 |
| WO | WO 94/21545 A1 | 9/1994 |
| WO | WO 97/32804 A1 | 9/1997 |
| WO | WO 01/64563 A2 | 9/2001 |

* cited by examiner

*Primary Examiner*—Peter M. Cuomo
*Assistant Examiner*—Sang Kim
(74) *Attorney, Agent, or Firm*—Breiner & Breiner, LLC

(57) ABSTRACT

A method for producing logs (L1, L2) of web material (N) wound around tubular cores wherein the tubular core (A1-A4) is equipped with glue to secure the initial end of the web material and allow winding. Part of the glue applied to the tubular core is transferred to the web material (N) before it is severed upon termination of winding the log, to seal the final free end of the formed log.

22 Claims, 8 Drawing Sheets

7
9
3B
3
3A
L1
A1
5
5A
11
13
$f_N$
N
1
6
A-A
19
15
17
37
21
A2
25
C
A3
35
31
27
A4
$f_A$
A
33
29
23

7
12
3B
3
3A
L1
A1
5
11
13
1
N
19
15
N
P
A2
37
C
A3
25
27

9
5
13
N
A1
3
3B
1
N
C
19
15
A2
P
17
37
A3
21
25
f25

7
9
A1
L1
12
3B
5
5A
13
fN
N
1
4f
C1
Li
3
3A
A-A
C
A2
19
15
17
37
21
A3
C
A4
25
27
fA

METHOD FOR PRODUCING LOGS OF WEB MATERIAL AND REWINDING MACHINE IMPLEMENTING SAID METHOD

TECHNICAL FIELD

The present invention relates to a method for producing logs of web material, for example rolls of toilet tissue, kitchen towels or the like.

The invention also relates to a rewinding or winding machine for forming logs destined to produce small rolls of wound web material.

STATE OF THE ART

Currently, to produce rolls of toilet tissue, rolls of kitchen towels or similar products a web material is unwound from one or more parent reels of large diameter, coming directly from the paper mill, and predetermined quantities of web material are rewound on tubular winding cores to obtain logs of a length equivalent to the length of the parent reel but with a minor diameter, equivalent to the diameter of the final product. These logs are subsequently cut crosswise to their axis to produce rolls or small rolls of web material destined to be packaged and distributed. Before cutting the logs into small rolls with lower axial dimensions, the initial free end of the web material must be glued to adhere to the external surface of the log and thereby allow subsequent handling, without the risk of accidentally unwinding the web material.

The rewinding machines currently used wind the logs, which are then conveyed to a gluing unit that glues the final free end of the web material. For this purpose, the individual logs are partially unwound and positioned to apply the glue to the unwound free end or to a portion of the cylindrical surface of the log that is subsequently covered with the final free end of the material by rewinding it.

Examples of gluing units to seal the final end of a web material forming a log are described in U.S. Pat. No. 5,242,525, EP-A-0481929, U.S. Pat. Nos. 3,393,105, 3,553,055, EP-A-0699168.

To produce logs of web material rewinding machines of the so called peripheral type are preferably used, in which the log being formed is made to rotate through contact with a plurality of motor-driven winding rollers, a plurality of belts or with combined systems of belts and rollers. Examples of rewinding machines of this type are described in WO-A-9421545, U.S. Pat. No. 4,487,377, GB-B-2150536 and others.

With these traditional machines at least a rewinding machine and a gluing unit are required to obtain the completed and glued log, ready to be subsequently cut into small rolls. U.S. Pat. No. 4,487,377 describes a method that makes the use of a gluing unit downstream of the rewinding machine unnecessary. In this method, the web material is cut upon termination of winding a log and the final end of the web material of the completed log is glued after cutting by transferring to it a glue previously distributed in annular strips on the tubular winding core introduced into the winding area. The glue applied to the tubular core also serves to start winding the new log.

This system makes it possible to eliminate the gluer, although it requires a particular configuration of the rewinding machine, with a cutting blade disposed so as to cooperate cyclically with the winding roller. With a layout of this type it is not possible to attain the performances currently required of these machines in terms of production speed and production flexibility.

WO-A-9732804 describes a rewinding machine with a gluing unit incorporated. Nonetheless, owing to the design and layout of the gluing unit, this rewinding machine is only capable of reaching relatively low winding speeds. Moreover, even if the winding elements and the gluing elements are incorporated in the same machine, it still has a gluing unit which is separated in respect of to the elements to wind the web material on the previously glued tubular cores.

WO-0164563 describes a rewinder wherein, upon termination of winding a log, a first glue is applied to the web material to seal the free end of the formed log. A second glue is applied to the new winding core before it is introduced into the machine.

OBJECTS AND SUMMARY OF THE INVENTION

The object of the present invention is to provide a method for producing logs of wound web material, that makes it possible to glue the final end of the rolls or logs, without requiring a gluing unit downstream of the rewinding machine or incorporated in it, and which makes it possible to obtain a high level of precision in applying the glue to the web material to seal it.

According to a particular aspect a further object of the present invention is to provide a method that makes it possible to attain high performances in terms of production flexibility.

A further object of the present invention is to produce a rewinding machine that makes it possible, reaching adequate production speeds, to avoid the use of a gluing unit downstream of the rewinding machine, performing the operations to glue the final end of the log formed inside the rewinding machine, without requiring specific gluing elements.

The invention is based on a method per se known and described in U.S. Pat. No. 4,487,377. This method includes the following phases:

- winding a quantity of web material around a first winding core to form a first log in a winding area
- upon termination of winding the first log, bringing a second winding core, provided with glue on its surface, into contact with said web material;
- severing the web material to produce a final end of the first log and an initial end to form a second log around said second winding core;
- transferring a part of the glue from the second winding core to a portion of web material destined to be wound on the first log, in proximity to the final free end, which is glued to the first log unloading said log from the winding area.

Characteristically, according to the invention, the glue is transferred from the winding core to the web material before the web material is severed to produce the final free end of the completed log and the initial free end of the new log to be wound.

As shall be apparent to those skilled in the art from the following description of a particularly advantageous example of embodiment, this makes it possible to implement the method in a particularly simple way and with a versatile and high speed rewinding machine.

According to an advantageous and preferred embodiment of the invention, the method is characterized by:

- feeding the web material around a first winding element;
- positioning a rolling surface at a distance from said first winding element to define with it a channel for introducing the winding cores;

introducing said second winding core in said channel and making it roll, in contact with said rolling surface and with said web material fed around the first winding element;

after said second core has transferred part of the glue to the web material, severing the web material between said second core and said first log;

continuing to make said second winding core roll along said channel to start winding of the second log around it.

The glue may be applied to the tubular winding cores in annular bands. Nonetheless, according to a preferred embodiment of the invention, the glue is applied along at least a longitudinal band, i.e. parallel to the axis of the tubular winding core. This longitudinal band may be suitably broken to prevent the glue applied from soiling the mechanical elements of the rewinding machine. In particular, when a rolling surface is provided to introduce the core into the winding area, this surface may be designed in the form of a comb, i.e. with an arrangement of elements parallel to and spaced apart from one another. The longitudinal band of glue applied to the core will be broken in areas corresponding to the position in which the core comes into contact with these supporting elements forming the rolling surface.

In an improved embodiment of the invention, two longitudinal bands are applied to the core, one destined to be transferred to the final free end of the completed log to seal it and the other destined to secure the initial free end of the web material to the new core. The two bands may be formed by glues with different characteristics, optimized for the two different functions.

Advantageously, the tubular core is introduced into the channel formed by the winding element and by the rolling surface in an angular position, such that the longitudinal band of glue applied to the tubular core is far from the contact area of the core with the web material fed around the winding element. In this way the tubular core starts to roll in the channel in contact with the web material fed around the winding element and the rolling surface for a sufficiently wide angle before the band of glue comes into contact with the web material. During this brief interval of time the web material may be tensioned through acceleration of a winding roller downstream of the area in which the tubular core is introduced, to prepare the web material for subsequent severing. Severing is obtained by exceeding the limit of tensile strength of the web material at the level of a perforation line provided on it. This severing occurs when the core is rolled for an angle greater than the one required to bring the longitudinal band of glue into contact a first time with the web material to deposit a fraction of the glue on the web material. Severing takes place along a perforation line located between the band of glue transferred to the web material and the core, before the band of glue on the core comes into contact for a second time with the web material. In this way the glue transferred to the web material is extremely near the line along which the web material is severed. Acceleration of the winding roller to obtain tensioning can also start after the glue has been transferred to the web material. The moment in which tensioning starts depends on the gradient of acceleration and on the characteristics of resistance and elasticity of the web material.

By applying glue along a longitudinal line, if necessary a broken line, makes it possible to distribute on the web material—in proximity to the area in which the final free end of the material wound on the finished log is produced—a longitudinal band of glue parallel to the edge of the free end.

Continuing to roll between the rolling surface and the winding element the core will make another complete turn until the longitudinal band of glue is once again brought into contact with the web material nipped between the core and the winding element. This new contact will take place after the web material has been severed and therefore the initial free end produced by severing will remain glued to the tubular core along the longitudinal band of residial glue on the core to start winding the subsequent log.

Further advantageous characteristics and embodiments of the method according to the invention are set forth in the appended dependent claims.

The invention also relates to a peripheral rewinding machine of the automatic and continuous type, i.e. in which the web material is fed continuously at an essentially constant speed and the logs formed are automatically unloaded to be replaced by new tubular winding cores. More specifically, the invention relates to a peripheral rewinding machine of this type comprising:

a winding cradle with at least a first winding element around which said web material is fed;

a feeding means to introduce said winding cores towards said winding cradle;

means to sever the web material upon termination of winding each log;

a glue dispenser to apply a glue to said cores, before introducing them into said winding cradle;

and wherein the feeding means and the means to sever the web material are synchronized so that a winding core is brought into contact with the web material fed around said first web element before the web material is severed.

Characteristically, according to the invention, introduction of the winding core and operation of the means to sever the web material are coordinated so that the web material is severed in an area upstream, in respect of the direction of feed of the web material, of an area in which said winding core transferred part of the glue applied to it to the web material.

Further advantageous characteristics and embodiments of the rewinding machine according to the invention are indicated in the appended dependent claims.

BRIEF DESCRIPTION OF THE DRAWINGS

The invention will now be better understood by following the description and attached drawing, which shows a non-limiting practical example of the invention. In the drawing.

DETAILED DESCRIPTION OF THE PREFERRED EMBODIMENT OF THE INVENTION

Figure 1:
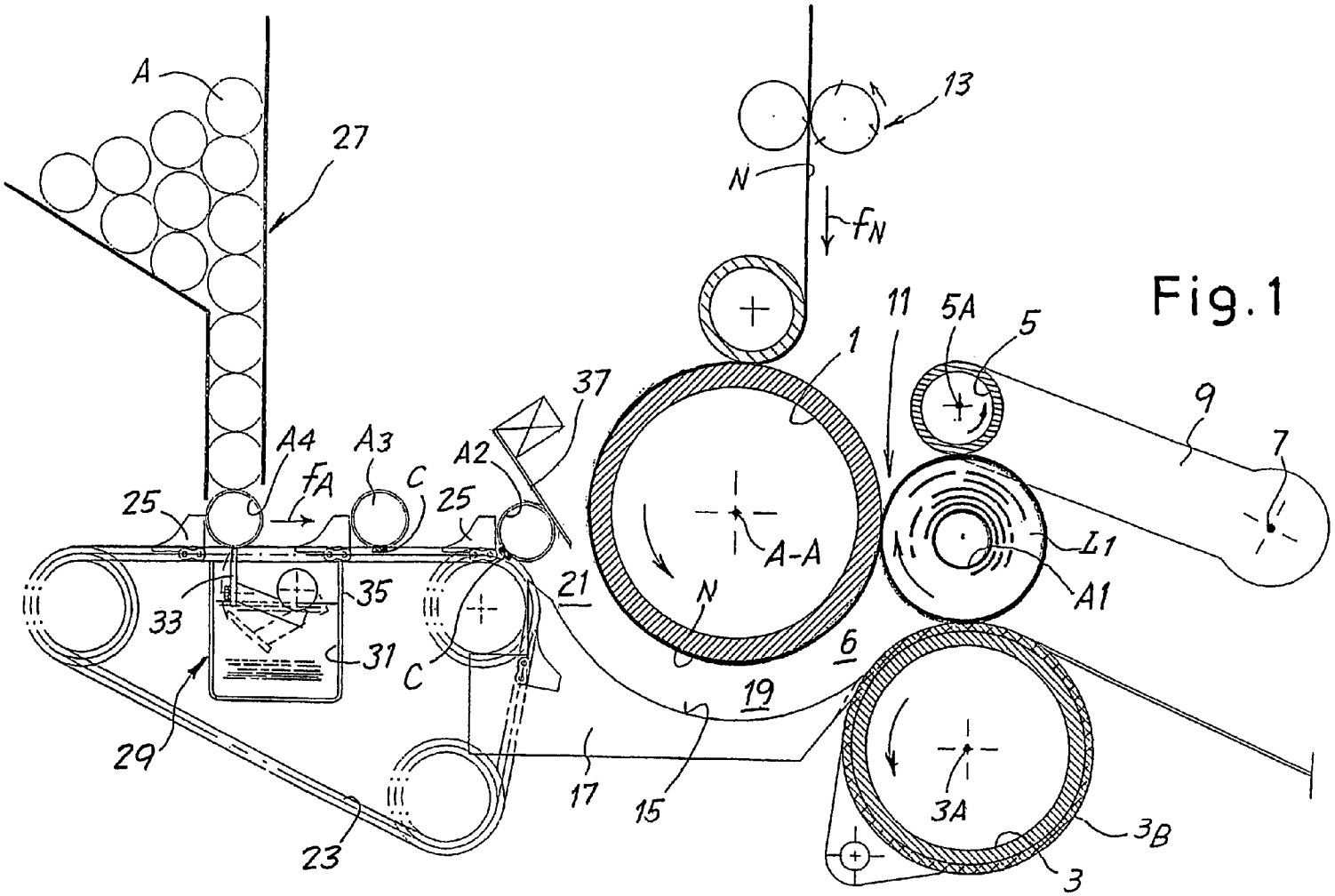
FIGS. 1 to 6 schematically show the principal elements of the rewinding machine in an operating sequence in the exchange phase, wherein the finished log is unloaded, a new winding core is introduced and winding of a new log starts.

FIG. 1 shows the principal elements of the rewinding machine, the description of which shall be restricted to the description required to understand the present invention.

The rewinding machine, indicated as a whole with 1, comprises a first winding roller 1, rotating around an axis A-A, a second winding roller 3, rotating around a second axis 3A parallel to the axis A-A, and a third winding roller 5, rotating around an axis 5A parallel to the axes A-A and 3A and moving around an axis 7 of oscillation, around which oscillating arms 9 to support the winding roller 5 are supported. The three winding rollers 1, 3 and 5 define a winding cradle 11 inside which, in the position shown in FIG. 1, a first log L1 of web material is found in the final winding phase.

A nip 6 is defined between the winding rollers 1 and 3 through which the web material N passes and is wound around to form the log L1. The web material N is fed around the first winding roller 1 and, before reaching it, through a perforator unit 13 that perforates the web material N along perforation lines equidistant and substantially orthogonal to the direction of feed of the web material. In this way the web material N wound on the log L1 is divided into sheets that can be separated individually by being torn by the final user.

A rolling surface 15, essentially concave cylindrical and coaxial to the winding roller 1, extends around a portion of said winding roller 1. The rolling surface 15 is formed by a series of strips parallel to and spaced apart from one another, one of which is shown in the drawing and indicated with 17, the others being superimposed on it. The strips 17 terminate with a narrow portion that is introduced into annular channels 3B of the second winding roller 3. The layout is analogous to the one described in WO-A-9421545, the content of which may be referred to for greater details concerning the construction of these rolling surfaces.

The rolling surface 15 forms, with the external cylindrical surface of the winding roller 1, a channel 19 to introduce the tubular winding cores. The channel 19 extends from an inlet area 21 to the nip 6 between the winding rollers 1 and 3. It has a height, in a radial direction, equal to or slightly below the diameter of the tubular winding cores, which must be sequentially introduced into the winding area in the manner described below.

The tubular winding cores are taken to the inlet 21 of the channel 19 by a conveyor 23 comprising two or more flexible elements parallel with one another and equipped with pushers 25 that collect each single tubular winding core A (A1, A2, A3, A4) from a hopper above 27. Under the hopper 27 is a glue dispenser, indicated as a whole with 29, comprising a tank of glue 31, inside which a moving gluing element 33 oscillating around an axis 35 orthogonal to the plane of the figure is immersed. The gluing element 33 alternatively adopts a first position (shown with a dashed line in FIG. 1), wherein it is immersed in the glue contained in the tank 31, and a raised position, shown with a solid line in FIG. 1, wherein it touches the tubular winding core in the lowest position in the core unloading channel under the hopper 27, that is core A4 in the figure. The gluing element 33 has a rim, equipped with an upward facing groove if needed, on which the glue is collected to be applied along a corresponding longitudinal band on each single core unloaded from the hopper 27 onto the conveyor 23 below, before being transferred with a movement according to the arrow fA towards the winding area. It must be understood that other conveying and gluing systems may be used to convey the tubular winding cores and to apply glue to them, preferably along longitudinal lines, that is parallel to the axis of said cores.

In the position in FIG. 1 the tubular winding cores A2 and A3 are already equipped with a longitudinal band of glue, indicated with C. This band may be broken in positions corresponding to the positions in which the strips 17 are disposed, so that the longitudinal edge of the gluing element 33 has a series of breaks distributed appropriately along its extension.

The tubular winding core A2 is in proximity to the inlet 21 of the channel 19 and is held there by an elastic strip 37. It will be introduced at an appropriate moment into the channel 19 and will start to roll on the rolling surface 15 through the effect of contact with the web material N fed around the winding roller 1. Introduction is obtained by a sudden movement of the conveyor 23 and through the effect of the thrust of the pusher 25, by an auxiliary introduction means of a per se known type (see for example WO-A-9421545) or in any other suitable way.

The rewinding machine summarily described hereinbefore operates as follows.

As mentioned above, FIG. 1 shows a roll or log L1 in the terminal phase of winding onto a tubular winding core A1. The tubular winding core A2, equipped with the band of glue C, is at the inlet 21 of the channel ready to be introduced into the winding area. The web material N advances according to the arrow fN from the perforator 13 to the winding roller 1 until reaching the winding cradle 11 where it is wound around the log L1.

Figure 2:
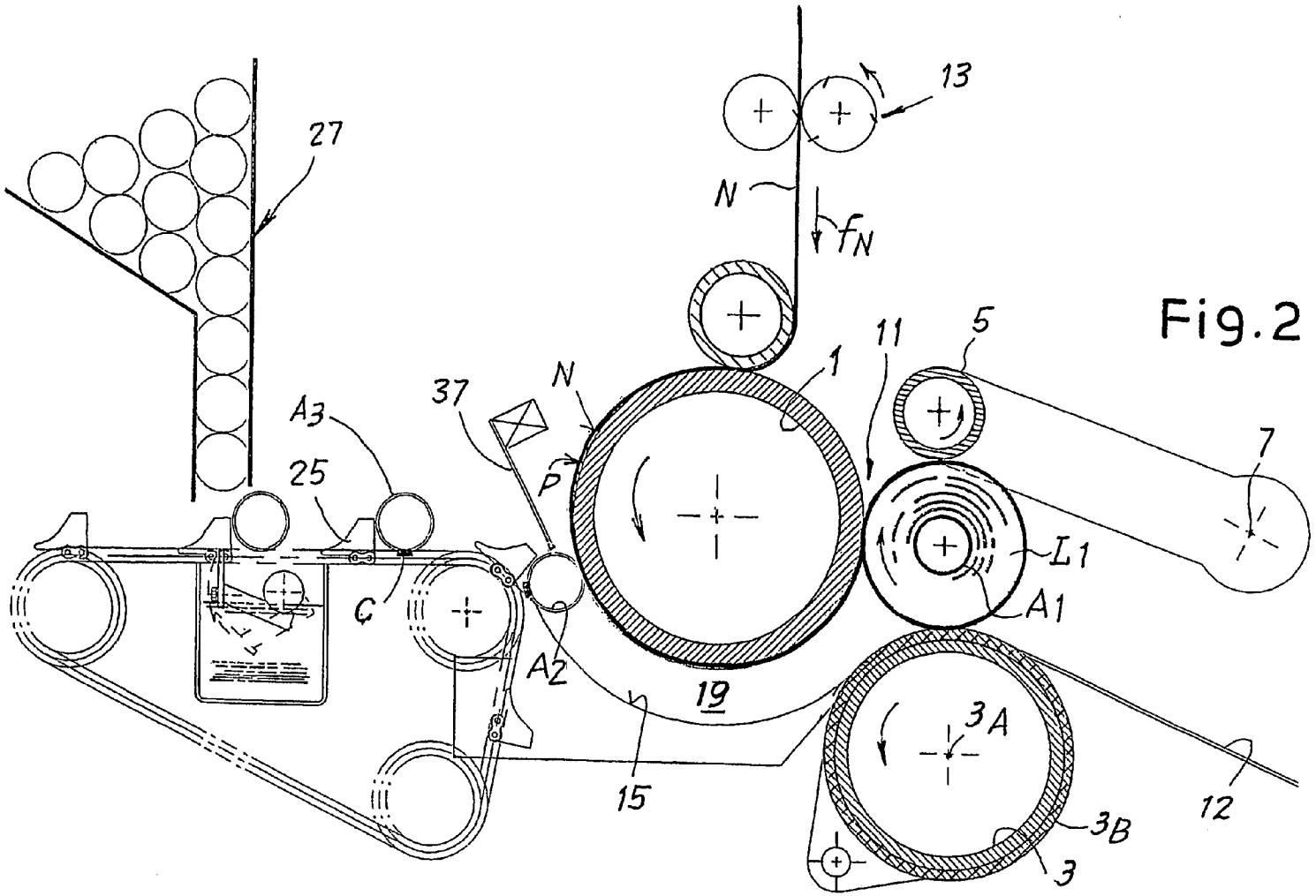

FIG. 2 shows the phase to introduce the tubular core A2 into the channel 19. It is forced into the channel to come into contact with the web material N, pressing it against the cylindrical surface of the first winding roller 1, and with the rolling surface 15. Upstream of the contact point between the web material and the tubular core A2 the position of the perforation line P along which the web material will be severed in the manner described below is shown. The log L1 continues to be wound in the winding cradle 11. Introduction of the core is suitably synchronized with the position of the perforation line along which the web material must subsequently be severed.

Figure 3:
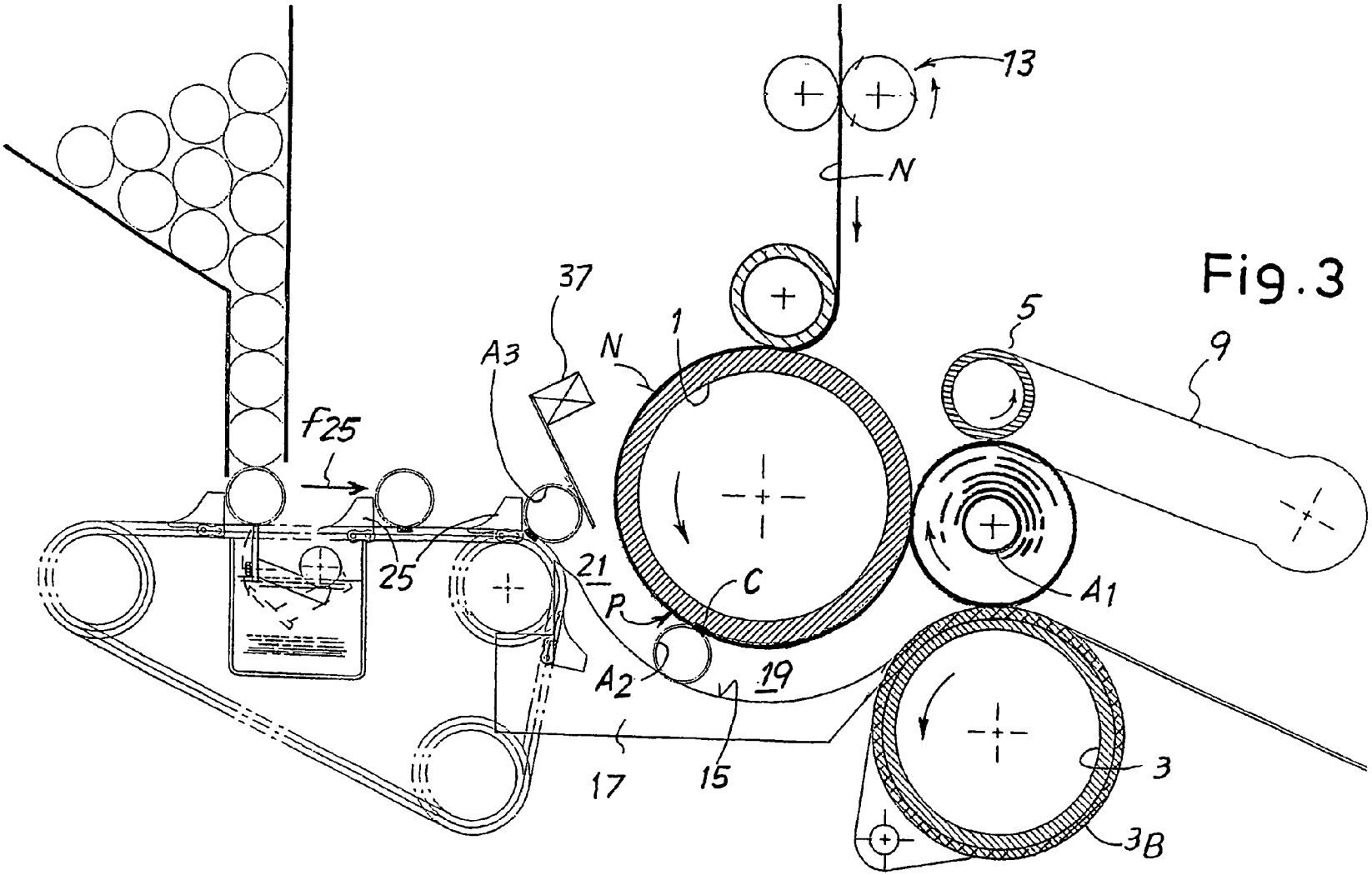

Due to the rotating movement of the winding roller 1, the tubular winding core A2 rolls on the surface 15 advancing along the channel 19. In this movement the longitudinal band of glue C moves from the position in FIG. 2 (wherein it was in an area of the core A2 diametrically opposite its contact area with the web material N) to the position in FIG. 3, where the band of glue C is positioned in the contact area between the tubular winding core A2 and the web material N fed around the first winding roller 1. At this moment part of the glue C from the band is transferred to the web material N. This band is positioned slightly downstream of the perforation line along which the web material will be severed.

Figure 4:
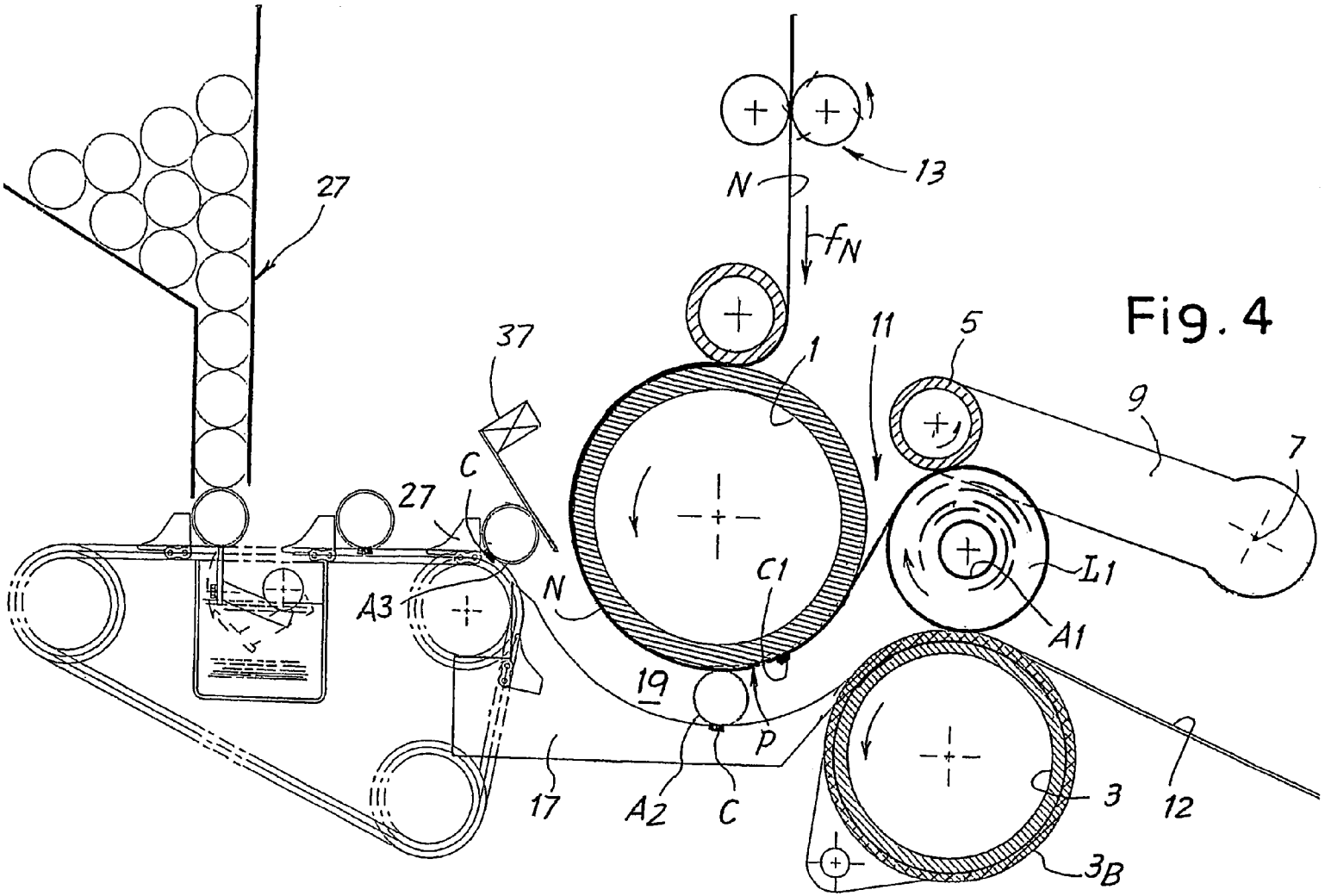

Continuing the rolling movement of the tubular winding core A2 along the channel 19, the position shown in FIG. 4 is reached. The longitudinal band of glue C is again in a position more or less diametrically opposite in relation to the contact area between the tubular winding core A2 and the web material N fed around the winding core 1. The portion of glue transferred from the tubular winding core A2 to an area of the web material N is indicated with C1.

Simultaneously, the third winding roller 5 as been accelerated and, if necessary, the second winding roller 3 has been decelerated. Consequently, the log L1 in the completion phase starts to move away from the first winding roller 1 and gets ready to be unloaded onto an unloading surface 12. Acceleration of the upper moving winding roller 5 also causes tensioning of the web material N in the area between the log L1 and the point in which the material is pinched between the winding roller 1 and the tubular winding core A2. This occurs because the speed at which the web material N is fed to the winding roller 1 and the peripheral speed of the latter remain constant, while the speed of the contact point between the log L1 and the winding roller 5 increases.

At a certain point this increase in tension will exceed the breaking point of the web material along the perforation line predetermined for severing. This perforation line is disposed between the log L1 and the point in which the web material is pinched between the tubular winding core A2 and the first winding roller 1. The position of this perforation line may be adequately and precisely controlled in a per se known way.

Figure 5:
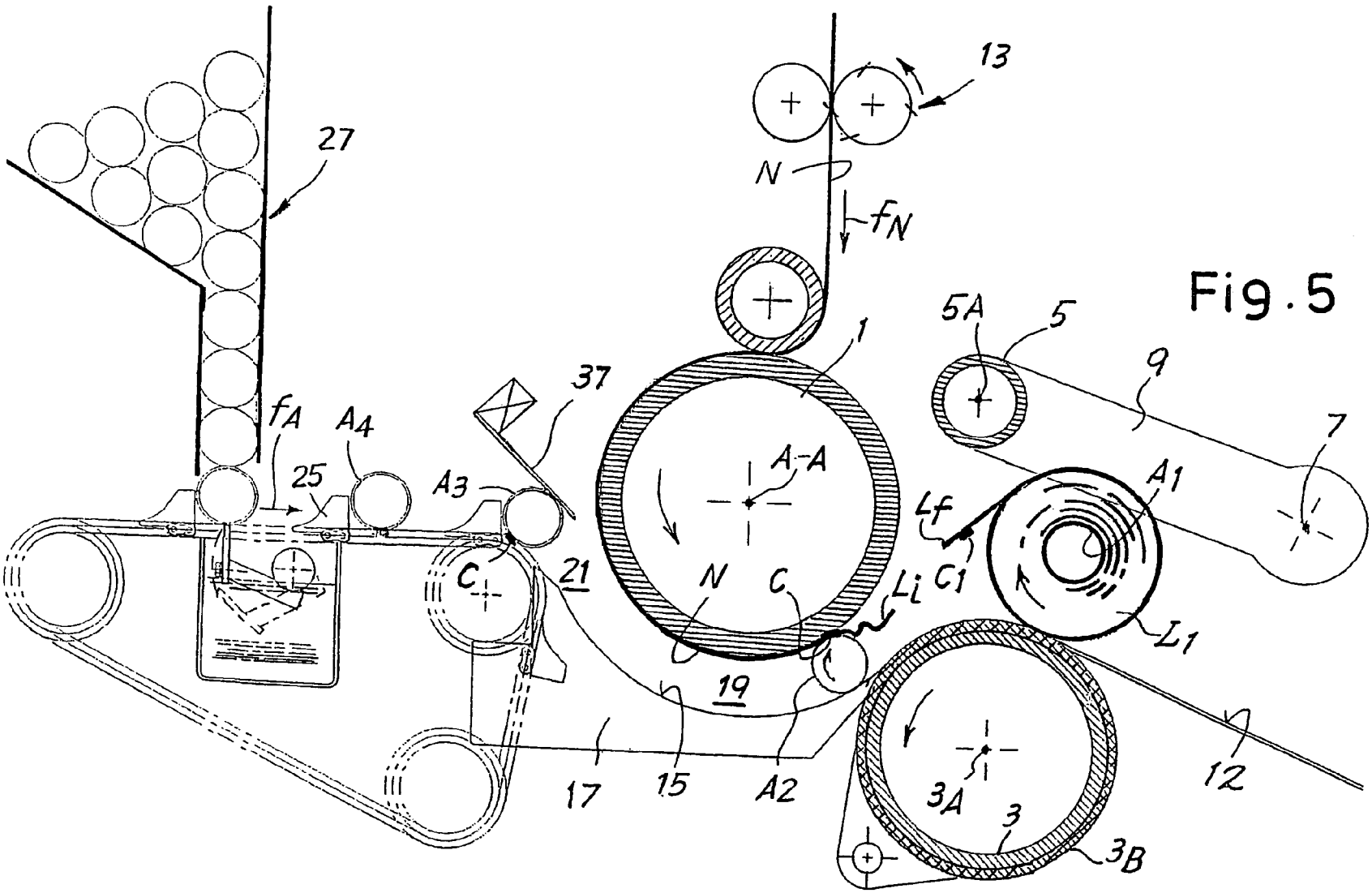

FIG. 5 shows a moment successive to severing the web material N. This severing produces a free tail end Lf, which will finish winding around the log L1, and a free leading end L1 which will start winding around the new tubular winding core A2. The free tail end Lf is produced in close proximity to the band C1 of glue that the tubular core A2 has transferred to the web material N wound around the log L1. The free leading end L1 will start to wind around the tubular core A2 through the web material being secured to the tubular core by the residual glue of the longitudinal band of glue C.

Figure 6:
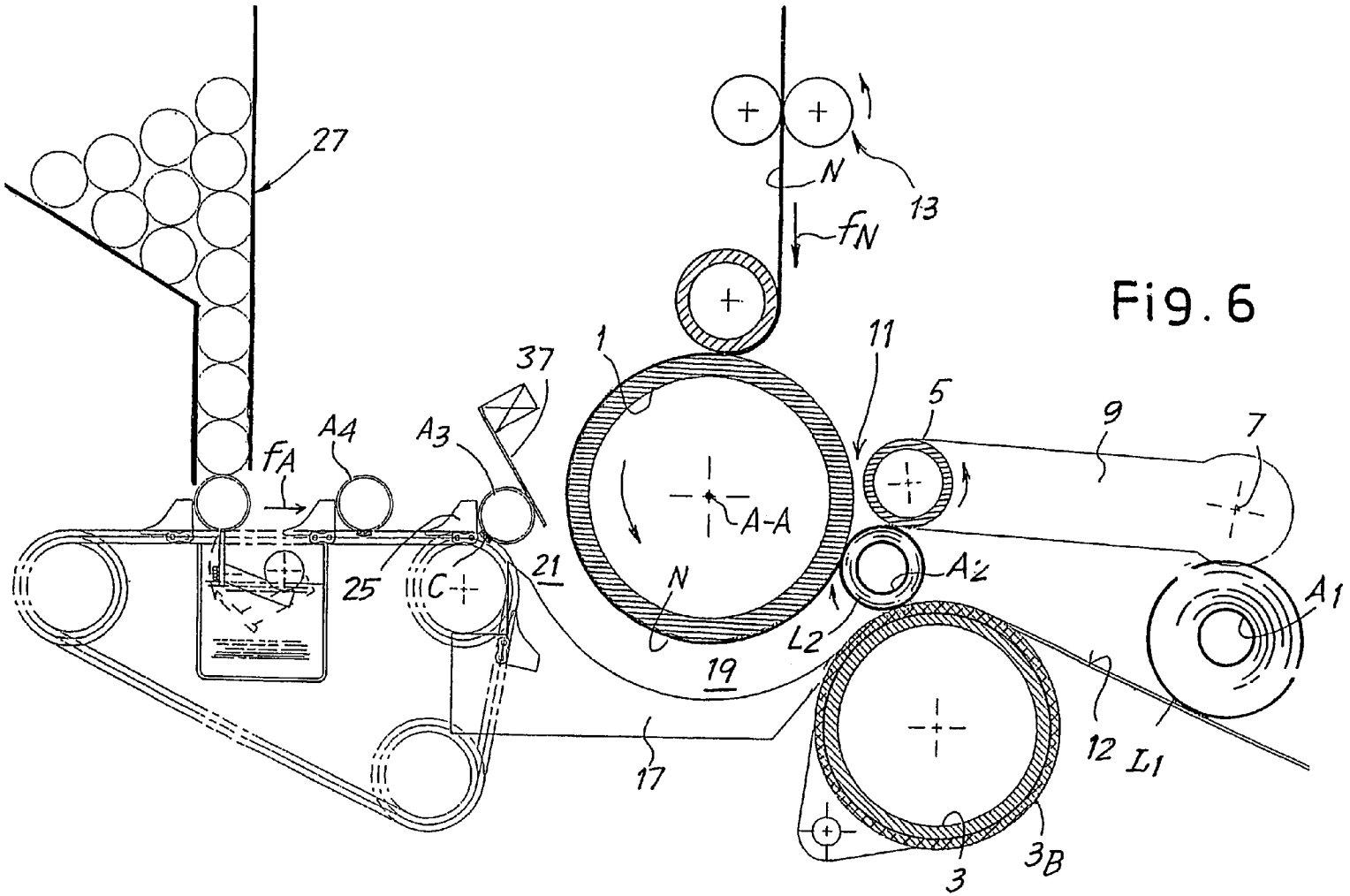

FIG. 6 shows a subsequent phase of the winding cycle, wherein the completed log L1 is unloaded onto the unloading surface 12, while the tubular winding core A2 is in the winding cradle 11 and a certain quantity of web material has started to be wound around it to form the initial part of a new log indicated with L2. After oscillating upwards to allow unloading of the completed log L1, the winding roller 5 with moving axis returns to the low position and is once again in contact with the new log L2 being formed. The conveyor 23 has advanced by one step to take the tubular winding core A3 to the position previously occupied by the tubular winding core A2 (FIG. 1). The peripheral speed of the winding rollers 3 and 5 has returned to the nominal value more or less equivalent to the peripheral speed of the winding roller 1. In this position the machine is ready to start a new exchange cycle when the log L2 is completed and the winding core A3 will be introduced into the feed channel 19 in the same way described hereinbefore.

From the description hereinbefore it is clear that the logs L1, L2, etc. are equipped with a longitudinal band of glue C1 required to make the free tail end Lf adhere to the external surface of the log when it rolls onto the unloading surface 12. There is therefore no need to provide a gluing device disposed downstream of the rewinding machine. The absence of blades or other cutting elements makes it possible to reach a high level of production flexibility, as any quantity of web material may be wound.

The figures described hereinbefore show an example of embodiment wherein a single longitudinal band of glue is applied to the tubular core. The quantity of glue C is sufficient to wet the free tail end of the formed log and the free leading end destined to be secured to the new tubular core. Nonetheless, two longitudinal bands of glue may be applied to the same core in two different angular positions, one destined to glue the free tail end of the completed log and the other to secure the free leading end to the new core. In this case two different glues may be used for the two bands, taking into consideration the different gluing requirements. While the final free end of the log requires light gluing, the initial free end must adhere efficiently and rapidly to the new core.

Figure 7:
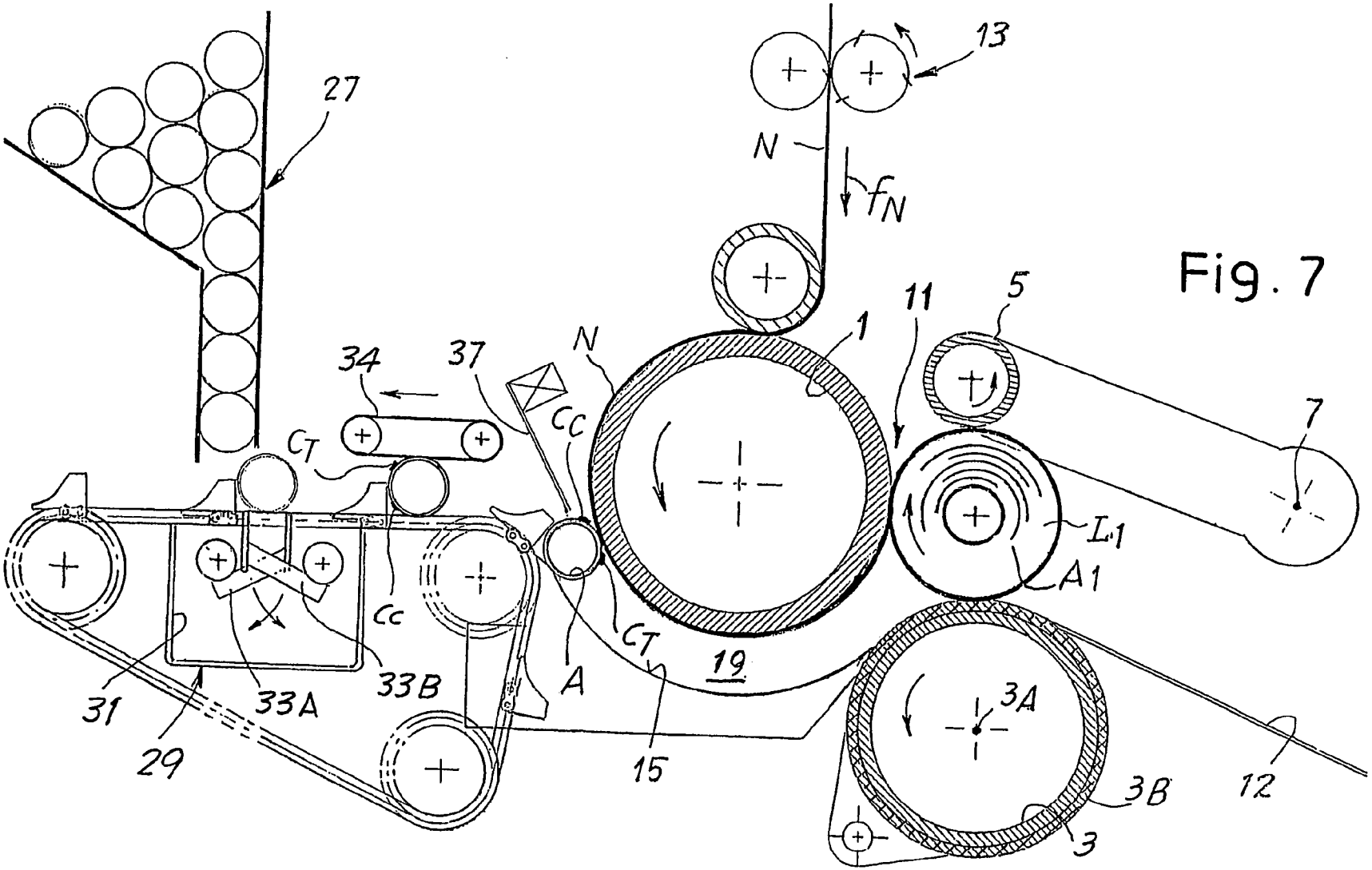
FIGS. 7 and 8 show two alternative embodiments of the invention.

FIG. 7 shows a first embodiment of the machine that allows two bands of glue to be applied in two different angular positions using different glues. In this case two gluing elements 33A and 33B are provided immersed in two separate tanks containing two different glues. When the core is in the gluing position, it receives two bands $C_C$ and $C_T$ of glue of different qualities in different angular positions. The glue $C_C$ is destined to glue the free tail end or tail edge of the completed log, while the glue $C_T$ is destined to glue the free leading end to the new core.

Before each core is introduced into the channel 19 formed between the roller 1 and the rolling surface 15 it is made to rotate through more or less 180°, for example by a belt 34 disposed in a suitable position along the core introduction path. In this way, as shown schematically in FIG. 7, the core is fed into the channel 19 in an angular position that brings the core and the web material into contact in the portion of cylindrical surface lying between the bands $C_T$ e $C_C$. When the tubular core starts to roll along the channel 19 the band of glue $C_C$ first touches the web material N and the glue is transferred to an area adjacent to the line along which the material is severed, but downstream of said line. The core continues to roll and the material is severed as described hereinbefore, but the free leading end that must be secured to the core A is glued by the band of glue $C_T$ that touches the web material after severing and after the core has rotated for slightly less than one complete turn.

Rather than applying the glue from below and rotating the core through 180°, it is also possible to apply the glue from above, again along two bands disposed appropriately on the core.

Figure 8:
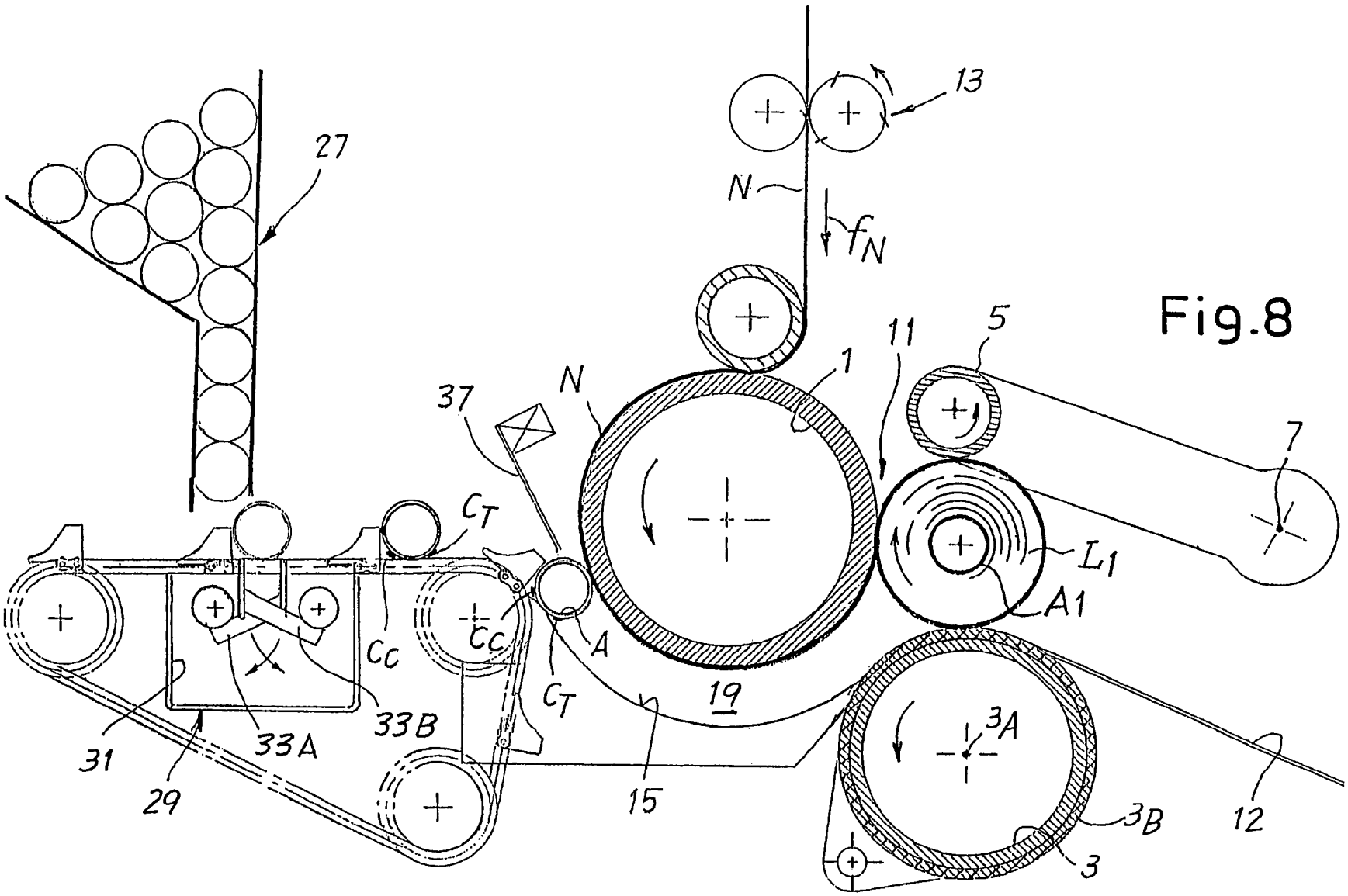

FIG. 8 shows an embodiment modified in relation to the one in FIG. 7 and wherein the tubular core is not rotated through 180° after the glue is applied. In this case the reciprocal position of the bands $C_C$ and $C_T$ is inverted so that the first band to touch the web material is again the band $C_C$. Less time is available to perform severing of the web material than in the previous case, as the second band of glue $C_T$ touches the web material after a relatively small angle of rotation of the tubular core.

It is understood that the drawing merely shows an example given purely as a practical embodiment of the invention, which may vary in shapes and arrangements without however departing from the scope of the concept on which the invention is based. Any reference numbers in the appended claims are provided to facilitate reading of the claims with reference to the description and the drawing, and do not limit the scope of protection represented by the claims.

The invention claimed is:

1. A method for producing logs of wound web material, comprising:

winding a quantity of web material around a first winding core to form a first log in a winding area;

upon termination of winding the first log, bringing a second winding core, with glue on a surface thereof, into contact with said web material;

severing the web material to produce a tail end of the first log and a leading end to form a second log around said second winding core;

transferring a portion of the glue from the second winding core to a portion of the web material to be wound on the first log, in proximity to the tail end, which is glued to the first log, and unloading said log from the winding area, wherein said portion of the glue is transferred by the second winding core to the web material before severing of the web material.

2. The method as claimed in claim 1, further comprising feeding the web material around a first winding element;

positioning a rolling surface at a distance from said first winding element to define with the first winding element a channel for introducing winding cores;

introducing said second winding core in said channel and making the second winding core roll, in contact with said rolling surface and with said web material fed around the first winding element;

after said second winding core has transferred said portion of the glue to the web material, severing the web material between said second winding core and said first log;

continuing to make said second winding core roll along said channel starting winding of the second log around the second winding core.

3. The method as claimed in claim 1 or 2, wherein said severing of the web material is by tensioning said web material downstream of the second winding core, to exceed tensile strength of said web material.

4. The method as claimed in claim 3, wherein said tensioning of said web material occurs after the second core has been introduced into said channel.

5. The method as claimed in claim 3, further comprising rotating said core along said channel to complete approximately a full turn before said severing of said web material.

6. The method as claimed in claim 2, wherein said glue is applied to said winding cores as at least one longitudinal band.

7. The method as claimed in claim 6, wherein a single longitudinal band of said glue is applied to each core.

8. The method as claimed in claim 7, further comprising inserting the second winding core into said channel with the longitudinal band of said glue facing approximately opposite in respect to an area of contact of said core with the web material.

9. The method as claimed in claim 6, wherein two longitudinal bands of said glue are applied to each core, to glue the tail end of the first log and to secure the leading end to the second winding core.

10. The method as claimed in claim 9, wherein said two bands are composed of different glues.

11. The method as claimed in claim 6, wherein said at least one longitudinal band of glue is discontinuous.

12. The method as claimed in claim 2, wherein said first winding element is a winding roller.

13. The method as claimed in claim 12, wherein at least a part of winding takes place in a winding cradle defined by said first winding roller and by a second winding roller and a third winding roller.

14. The method as claimed in claim 13, wherein said severing of the web material is by accelerating said third winding roller.

15. A peripheral rewinding machine to produce logs of web material wound around tubular cores, comprising:

a winding cradle with at least a first winding element around which said web material is fed;

a feeding means to introduce said tubular cores towards said winding cradle;

a means to sever the web material upon termination of winding each log;

a glue dispenser to apply a glue to said cores, before introducing the cores into said winding cradle;

wherein said feeding means and said means to sever the web material are synchronized so that a winding core is brought into contact with the web material fed around said first winding element before the web material is severed, and wherein introduction of the winding core and operation of the means to sever the web material are coordinated so that the web material is severed in an area upstream, in respect to a direction of feed of the web material, of an area in which said winding core transfers a portion of the glue applied to the winding core to the web material.

16. The rewinding machine as claimed in claim 15, further comprising a rolling surface defining with said first winding element a channel to introduce said winding cores; and wherein said winding cores are introduced into said channel and made to rotate inside the channel before severing of the web material.

17. The rewinding machine as claimed in claim 15, wherein said means to sever the web material comprise at least a winding roller associated with acceleration means, which cause acceleration of said winding roller to tension and sever the web material between a completed log and a new winding core.

18. The rewinding machine as claimed in claim 15, wherein said glue dispenser is constructed and arranged to apply said glue along at least one longitudinal band on each of said cores.

19. The rewinding machine as claimed in claim 15, wherein said glue dispenser is constructed and arranged to apply said glue along a single longitudinal band on each core.

20. The rewinding machine as claimed in claim 19, wherein said glue dispenser, said feeding means and said channel are constructed and arranged so that the cores are introduced into the channel with the longitudinal band of glue facing approximately in a direction opposite to an area of contact between the tubular core and the web material fed around said first winding element.

21. The rewinding machine as claimed in claim 15, wherein said glue dispenser is constructed and arranged to apply on each core, at least two separate longitudinal bands of glue.

22. The rewinding machine as claimed in claim 21, wherein said glue dispenser is constructed and arranged to dispense different glues along said two longitudinal bands.

* * * * *